US006231372B1

(12) United States Patent
Doshita et al.

(10) Patent No.: US 6,231,372 B1
(45) Date of Patent: May 15, 2001

(54) CONNECTOR COUPLING STRUCTURE

(75) Inventors: Kenichi Doshita; Hiroshi Watanabe, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/552,684

(22) Filed: Apr. 19, 2000

(30) Foreign Application Priority Data

Apr. 22, 1999 (JP) ..... 11-114822

(51) Int. Cl.[7] ..... H01R 13/64
(52) U.S. Cl. ..... 439/376; 439/342
(58) Field of Search ..... 439/374, 342, 439/364, 359, 339, 362, 338, 376

(56) References Cited

U.S. PATENT DOCUMENTS 5,382,179 * 1/1995 Noschese ..... 439/369
5,586,901 * 12/1996 Muta ..... 439/376

FOREIGN PATENT DOCUMENTS 8-310316 11/1996 (JP) .
9-320697 12/1997 (JP) .

* cited by examiner

*Primary Examiner*—Brian Sircus
*Assistant Examiner*—Brian S. Webb
(74) *Attorney, Agent, or Firm*—Morgan, Lewis & Bockius LLP

(57) ABSTRACT

The connector coupling structure includes a connector frame 7 which has a connector 11 and a pillar-shaped projection 9 with a height higher than the connector 11 both being formed on the same face and a connector frame 3 which has a groove portion 16 in which the entirety of the connector frame 7, the connector 11 and the pillar-shaped projection 9 can be inserted. The bottom wall 19 of the groove portion 16 is configured so as to be slanted in a manner that the depth thereof becomes shallower toward the inner portion thereof from the opening position thereof. A connector 21 is provided at the inner side of the bottom wall 19 in opposite to the connector 11. The bottom wall 19 is provided at the opening side thereof in opposite to the pillar-shaped projection 9 with a hole 25 with a bottom wall in which the pillar-shaped projection 9 is inserted. The groove portion is formed in a manner that the distance between the both side walls 17 of the groove portion seen from the opening position thereof is substantially same as the width of the connector frame 7 at the inner side 17*b* of the groove portion and is gradually increased at a portion 17*a* near the opening position thereof.

7 Claims, 8 Drawing Sheets

CONNECTOR COUPLING STRUCTURE

BACKGROUND OF THE INVENTION

The present invention relates to connectors for performing the electrical connection between vehiclebody side wiring and vehicle parts having electric devices and, in particular, relates to a connector coupling structure which, at the time of assembling the vehicle parts to a vehicle body, introduces the connectors to a fitting position and corrects the position thereby to surely perform the connection of the connectors as well as the assembling of the vehicle parts to the vehicle.

FIG. 12 shows the connector coupling structure described in Japanese Patent Publication No. 8-310316A. This connector coupling structure is arranged in a manner that, when a bolt 91 for fixing an instrument panel 85 to a vehicle body 79 is fastened. by a not-shown nut from the vehicle body 79 side, a female connector 83 connected to a vehicle-body side wire harness 81 to be wired in the vehicle body 79 is connected to a male connector 89 of an instrument-panel side wire harness 87 to be wired within the instrument panel 85 and simultaneously the instrument panel 85 is fixed to the vehicle body.

The concrete arrangement of such a related connector coupling structure and the assembling operation thereof will be explained below. The fixing portion 93 of the vehicle body 79 for fixing the instrument panel 85 is provided with a projection portion 97 which is formed protrusively therefrom and has a not-shown bolt hole and a bolt insertion hole 95 communicating with the bolt hole. In contrast, the instrument panel 85 is provided with a fixing portion 99 which is extended from the left and right end portions of the instrument panel. The fixing portion is also provided with a bolt hole 101 and a projection portion 103 which is formed protrusively therefrom and has a not-shown bolt insertion hole communicating with the bolt hole 101. The both projection portions 97, 103 are provided on their outer peripheral faces with engagement projections 105, 107 for engaging with the connector, respectively. The housing 109 of the female connector 83 is provided with a fitting portion 111 which one side fitting with a male connector 89 is enlarged so as to fit with the housing 113 of the male connector 89. The housing 109 of the female connector 83 and the housing 113 of the male connector 89 have insertion holes 115, 117 for inserting the projections 97, 103 therein, respectively.

The assembling of the related connector coupling structure is performed in a manner that, first, the projection portion 97 of the vehicle-body 79 side is inserted into the insertion hole 115 of the female connector 83 and the projection portion 103 of the instrument panel 85 side is inserted into the insertion hole 117 of the male connector 89. Thereafter, the vehicle body 79 and the female connector 83 are provisionally assembled and also the instrument panel 85 and the male connector 89 are provisionally assembled while they are positioned so that the male terminal and the female terminal of the connector can be fitted. Then, the bolt 91 inserted from the bolt hole 101 of the fixing portion 99 of the instrument panel 85 is fastened by the not-shown nut from the fixing portion 93 side of the vehicle body 79.

However, in order to prevent the deformation of the connector housing and the breakage of the connector terminal occurred upon assembling, when provisionally assembling the female connector and the male connector, it is necessary to surely align the widths of the fitting portions of both the connectors and to position so that the both connector terminals are surely fitted.

Further, even after the both connector terminals are adjusted in their positions so that they are fitted surely, when the bolt is fastened excessively upon fastening the bolt by the nut, the connector housings and the connector terminals may be broken.

In this manner, the related technique has a problem that the workability at the time of assembling the vehicle parts such as the instrument panel etc. to the vehicle body is not good and so the assembling time increases.

SUMMARY OF THE INVENTION

Accordingly, an object of the present invention is to provide a connector coupling structure which can improve the workability of the assembling operation between vehicle parts on which connectors are mounted and a vehicle body etc.

In order to achieve the above object, according to the present invention, there is provided a connector coupling structure comprising:

a first connector frame including:

- a fitting groove, a first end portion thereof being opened, opposing side walls thereof having a first width at a second end portion thereof and being wider toward the first end portion, and bottom face thereof being slanted so as to be deeper at the first end portion;
- a first fitting hole formed on the bottom face of the first end portion of the fitting groove, the first fitting hole extending in a direction perpendicular to the fitting groove, the first fitting hole having a bottom;
- a first connector provided in the first fitting hole; and
- a second fitting hole formed on the bottom face of an intermediate portion of the fitting groove, the second fitting hole extending parallel with the first fitting hole; and a second connector frame including:

- a base plate having a width substantially identical with the first width of the fitting groove;
- a second connector provided on a first face of the base plate; and
- a fitting projection provided on the first face of the base plate, the longitudinal dimension thereof being longer than a longitudinal dimension of the second connector, the second connector frame inserted into the fitting groove from the opened first end portion thereof, slid along the fitting groove while the tip end of the fitting projection is abutted against the bottom face of the fitting groove to respectively fit the second connector and the fitting projection with the first fitting hole and the second fitting hole in order to couple the second connector with the first connector.

Preferably, a comer portion of the tip end of the fitting projection is tapered.

According to the above configuration, when the second connector frame is inserted into the fitting groove of the first connector frame from the opening of the first end portion, the second connector is introduced to the position to be fit with the first connector and corrected in its position by means of the slant side walls and the bottom face. When the fitting projection of the second connector frame is inserted into the second fitting hole of the first connector frame, the connectors are positioned at the fitting positions. Further, when the fitting projection is pushed into the second fitting hole, the first and second connectors are naturally coupled. In this manner, when the second connector frame is inserted from the opening of the first end portion of the fitting groove and slid therein, the second connector can be surely introduced to the fitting position and corrected in its position, whereby the connectors can be surely and quickly coupled.

Preferably, the second end portion of the fitting groove is closed wall face so that the second connector and the fitting projection respectively, faces to the first fitting hole and the second fitting hole when the side face of the base plate is abutted against the closed wall face.

Preferably, the first connector frame includes a bolt inserted from an opening formed on the bottom of the second fitting hole. The second connector frame includes a through hole piercing the fitting projection into which the bolt is inserted, and a nut buried in the fitting projection coaxially with the through hole, with which the bolt is fitted. The tightening operation of the bolt and the nut moves the second connector toward the first connector.

Preferably, the bolt includes a thread portion positioned so as to disengage from the nut when the first connector and the second connector are completely coupled after the tightening operation.

Preferably, the thread portion is formed such that the coupling length of the first connector and the second connector is substantially the same as an additional length of a length of the thread portion and a thickness of the nut.

Preferably, the fitting projection includes an engagement member formed on an circumferential face thereof. The fitting projection is inserted into an opening formed on a plate member, to which the second connector frame is fixed, such that the plate member is provisionally engaged between the engagement member and the first face of the base plate. An interval between the engagement member and the first face of the base plate is wider than the thickness of the plate member. The fitting projection includes elastic pieces extending from a base end portion thereof through the base plate, an interval of which is narrower than the diameter of the bolt so that the elastic pieces are spread out by the insertion of the bolt, thereby the plate member is movable between the engagement member and the first face of the base plate according to the insertion degree of the bolt.

According to the above configuration, to such a configuration, the fitting projection of the second connector frame provisionally engaged with the plate member is inserted into the second fitting hole of the first connector frame, then the first connector and the second connector are adjusted in their positions, and the bolt is inserted into the through hole and engaged with and fastened by the nut, so that the first and second connectors approach to each other in accordance with the feeding amount of the screw and coupled. When the bolt is further fastened, the thread portion of the bolt disengages from the nut and the fastening force for the bolt is released. Thus, even when the bolt is further fastened, both the connector housing and the connector terminals can be prevented from breakage. Further, in this case, since the tip end portion of the bolt is inserted between the elastic pieces, each of the plurality of elastic pieces is spread out by the bolt and the second connector frame is fixed to the plate member. In this manner, the parts of the vehicle at which the connector frames are mounted can be assembled to the vehicle body etc., the first and the second connectors can be fitted and the breakage of the connectors due to the excessive fastening at the time of the assembling operation can be prevented.

DETAILED DESCRIPTION OF THE PREFERRED EMBODIMENTS

The preferred embodiments of the connector coupling structure according to the present invention will be explained with reference to the accompanying drawings.

Figure 1A:
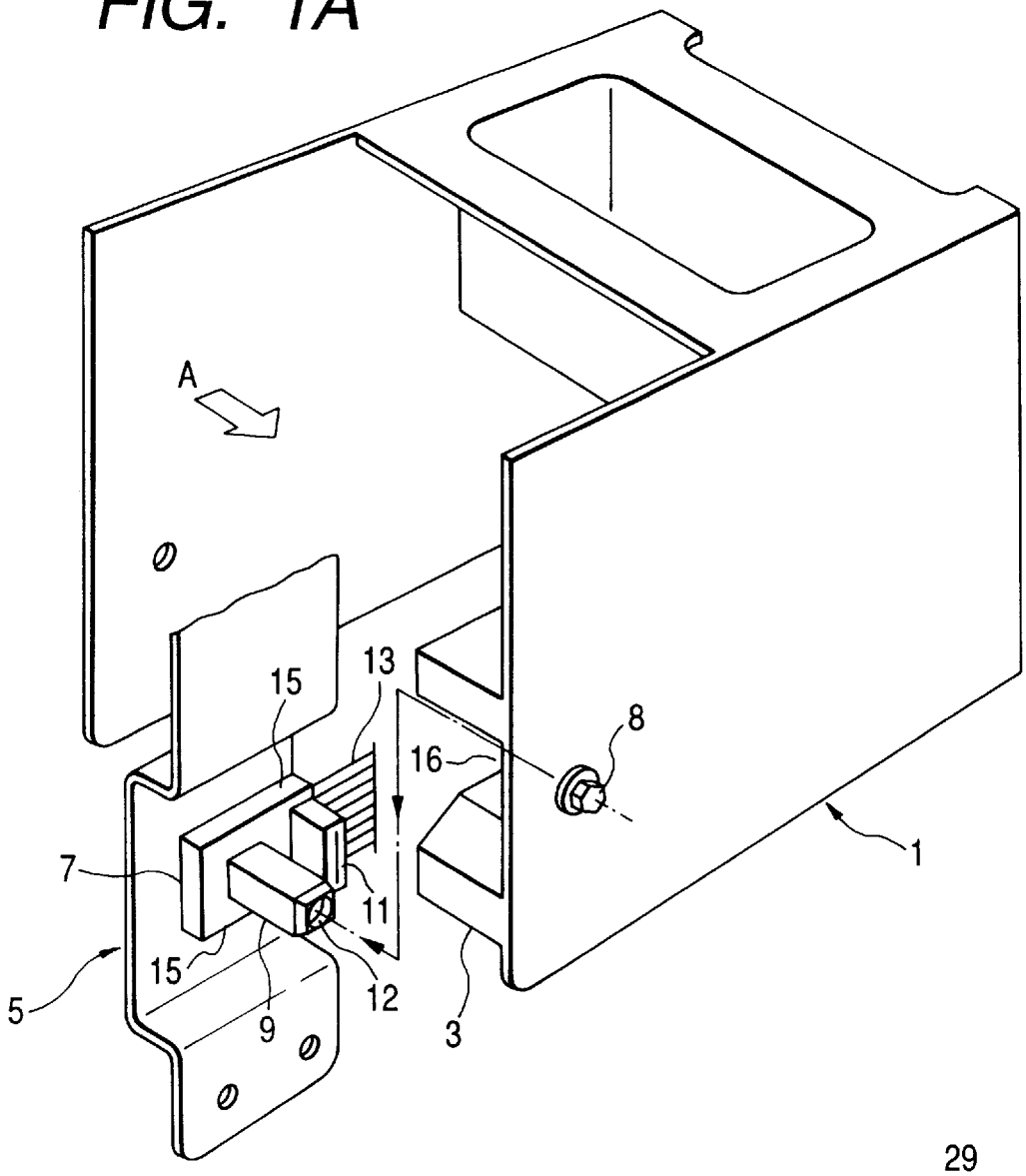
FIG. 1A is a perspective view showing a connector coupling structure provided with a vehicle body panel and a console box casing according to a first. embodiment of the present invention.
Figure 1B:
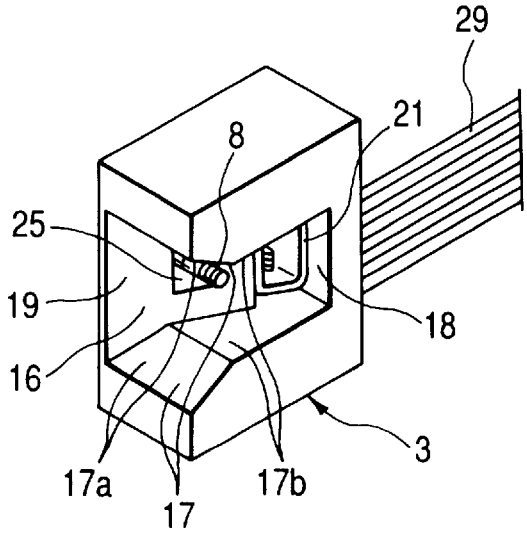
FIG. 1B is a perspective view only showing a connector frame provided with the console box casing, which is viewed from a direction indicated by an arrow A shown in FIG. 1A.
Figure 2:
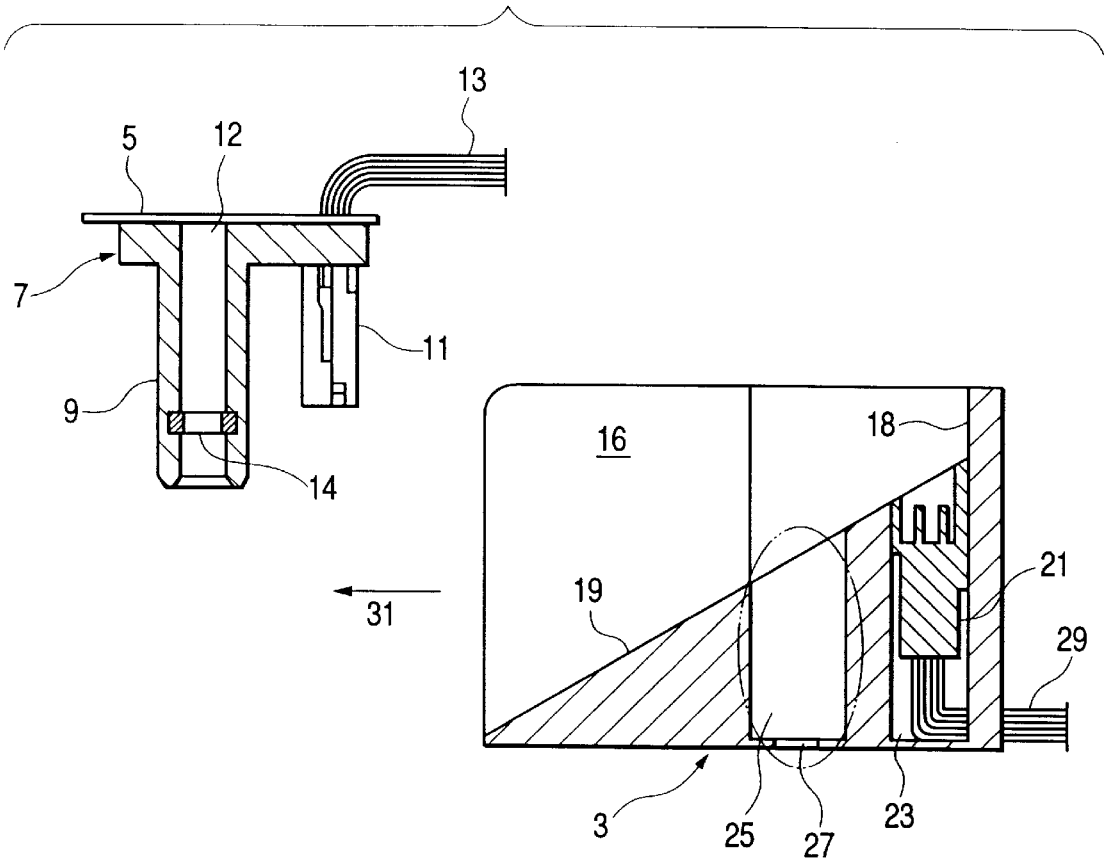
FIG. 2 shows the connector coupling structure of the first embodiment before performing the coupling operation.
Figure 3:
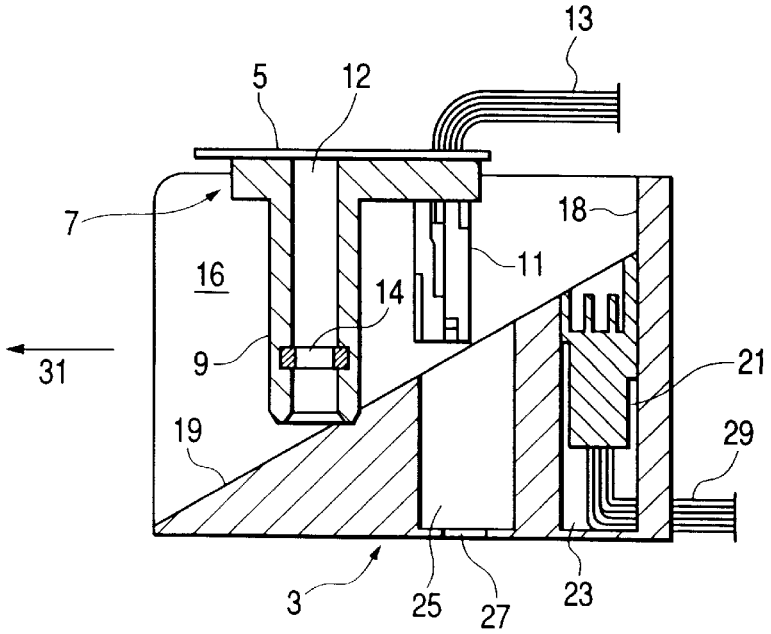
FIG. 3 shows the connector coupling structure of the first embodiment while performing the coupling operation.
Figure 4:
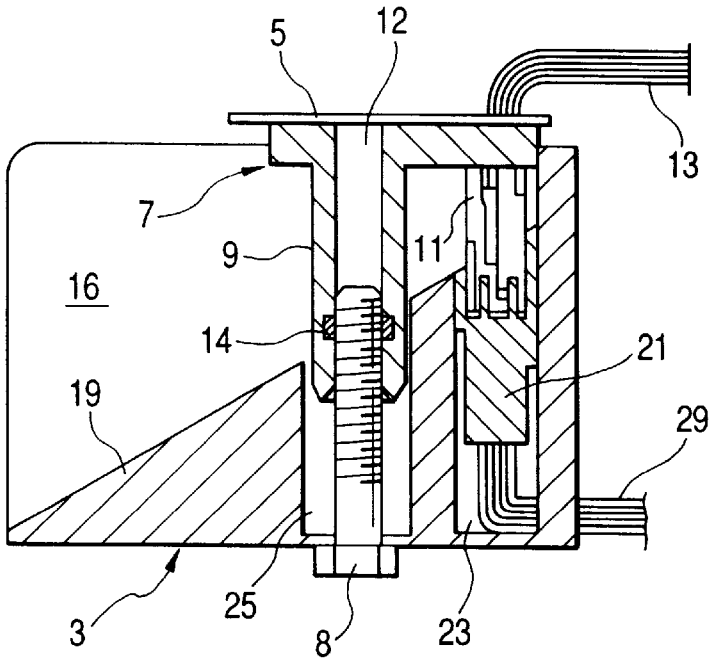
FIG. 4 shows the connector coupling structure of the first embodiment after the coupling operation has been completed.

The first embodiment will be explained with reference to FIGS. 1 to 4. FIG. 1A is a perspective view of the connector coupling structure provided with a vehicle body side panel and the casing of a console box. FIG. 1B is a perspective view showing only a connector frame portion viewed from a direction indicated by an arrow A shown in FIG. 1A. FIGS. 2 to 4 show the connector coupling operation.

As shown in FIG. 1, a connector frame 3 is integrally formed at the inner wall face of the casing I of the console box which is made of synthetic resin and fixed to the vehicle body. A connector frame 7 made of synthetic resin is fixed to a vehicle body side panel 5. The connector frame 7 is formed in a rectangular flat plate shape. A pillar-shaped projection 9 of a quadratic prism shape is integrally formed at the one face of this connector frame,. The tip portion of the pillar-shaped projection 9 is tapered at its four side corner portions to form slanted tip faces. The connector frame 7 has two sliding faces 15 on the long sides thereof which slides and contacts with the connector frame 3.

As shown in FIG. 2, the pillar-shaped projection 9 is provided with a through hole 12 for passing the shaft portion of a bolt 8 therethrough from the tip face of the pillar-shaped projection 9 toward the bottom face thereof. A nut 14 is buried within the pillar-shaped projection in a manner that its axle center portion is positioned coaxially with the through hole 12. A connector 11 is fixed to the connector frame 7. A wire harness 13 to be connected to the female side connector 11 is passed through a not-shown through hole provided at the vehicle body side panel 5 and the connector frame 7 and connected to the connector 11 from the back rear face side of the face of the connector frame 7 on which the pillar-shaped projection 9 is protrusively provided.

The connector frame 3 is also formed in a rectangular parallelepiped shape and provided with a groove portion 16 which is opened at one side face of this connector frame, as shown in FIG. 1. The two opposite side walls 17 of the groove portion 16 is configured at its portion near the opening to form tapered portions 17*a* whose width between the side walls 17 gradually increases toward the opening, and configured at its inner portion to form parallel portions 17*b* which oppose to each other in a parallel relation and have a width therebetween substantially same as the width of the two sliding faces 15 of the connector frame 7. The side wall of the groove portion 16 opposite to the opening is formed as an abutment face 18 against which the. connector frame 7 abuts. As shown in FIG. 2, the bottom wall 19 of the groove portion 16 is provided with a concave portion 23 to which a connector 21 is attached and a hole 25 with a bottom wall in which the pillar-shaped projection 9 of the connector frame 7 is inserted. A hole 27 through which the bolt 8 is inserted is provided at the bottom wall of the hole 25. The bottom wall 19 is configured so as to be slanted in a manner that the depth thereof becomes shallower toward the inner portion from the opening side and the bottom wall continues to the tip position of the inlet of the housing of the connector 21 attached to the concave portion 23. The wire harness 29 to be connected to the connector 21 is passed through a not-shown through hole provided at the side portion of the bottom portion of the concave portion 23 and connected to the connector 21. The connector 21 and the hole 25 are formed in correspondence with the connector 11 and the pillar-shaped projection 9 of the connector frame 7, respectively.

Then, the explanation will be made as to the assembling operation of the connector coupling structure according to the embodiment.

First, as shown in FIGS. 1 and 2, the casing 1 is moved close to the plate 5 so that the connector 21 opposes to the connector 11. Then, as shown in FIG. 2, the casing 1 is moved to the moving direction 31 so that the connector frame 7 is inserted from the end portion on the connector 11 side thereof into the groove portion 16 of the connector frame 3. In accordance with the movement of the casing 1, the connector frame 7 is inserted into the groove portion 16 toward the inner side thereof while being slid and guided along the tapered portions 17*a* of the opposite side walls 17. When the connector frame is introduced to the parallel portions 17*b* of the inner side walls, 17, the connector 11 and the connector 21 are naturally set in their positions along the. vertical direction in FIG. 1. In the process of inserting the connector frame 7 into the groove portion 16 of the connector frame 3, as shown in FIG. 3, the casing 1 is moved to the moving direction 31 while sliding the tip end of the pillar-shaped projection 9 of the connector frame 7 along the bottom wall 19 of the groove portion 16, and when the hole 25 with the bottom wall reaches the position of the pillar-shaped projection 9, the pillar-shaped projection 9 is inserted into the hole 25 with the bottom. Thus, the connector 11 and the connector 21 are placed at the position capable of being coupled to each other. The connector 21 is also adjusted in its position since the abutment face 18 of the connector frame 3 abuts against the connector frame 7. In such a positional situation, as shown in FIG. 4, the bolt 8 is inserted into the hole 27 and screwed into and fastened by the nut 14 buried in the pillar-shaped projection 9, whereby the casing 1 moves to such a direction that the connector frame 3 approaches the connector frame 7. Thus, the connector 21 and the connector 11 approach to each other and are coupled, whereby the attachment of the casing 1 to the plate 5 is completed.

In this manner, the connector 21 is introduced to the position to be fit with the connector 11 and corrected in its position by means of the tapered portions 17*a*, the parallel portions 17*b* and the bottom wall 19 of the side walls 17 formed at the connector frame 3. Further, the connector 11 and the connector 21 are surely adjusted in their positions by means of the pillar-shaped projection 9 and the hole 25 with the bottom wall. Furthermore, the connectors can be coupled and the assembling of the casing 1 with the plate 5 can be completed by fastening the bolt 8. Thus, it becomes possible to quickly perform the positional alignment operation of the widths of the fitting-portions of both the connectors and the coupling operation of both the connectors, so that the workability can be improved in the operations such as the assembling of the parts of the vehicle at which the connectors are mounted to the vehicle body. Further, it becomes possible to prevent the deformation of the connector housing and the damage of the terminals within the connector housing caused by the deviation between the widths of the fitting portions of both the connectors.

Figure 5:
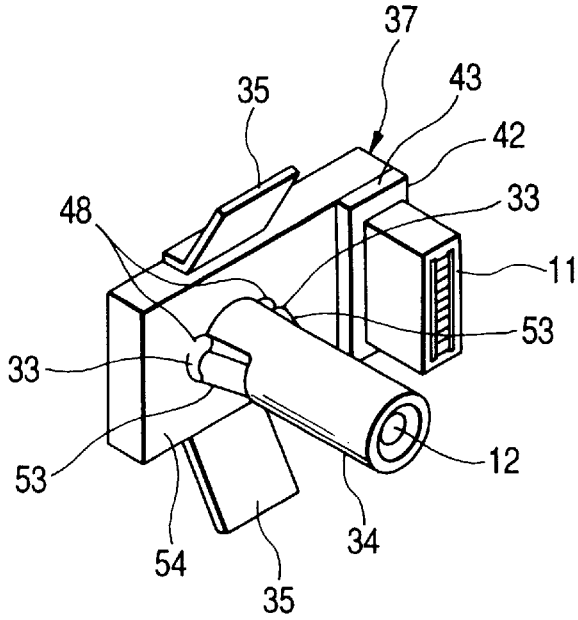
FIG. 5 is a perspective view showing a connector frame of a connector coupling structure according to a second embodiment of the present invention.
Figure 6A:
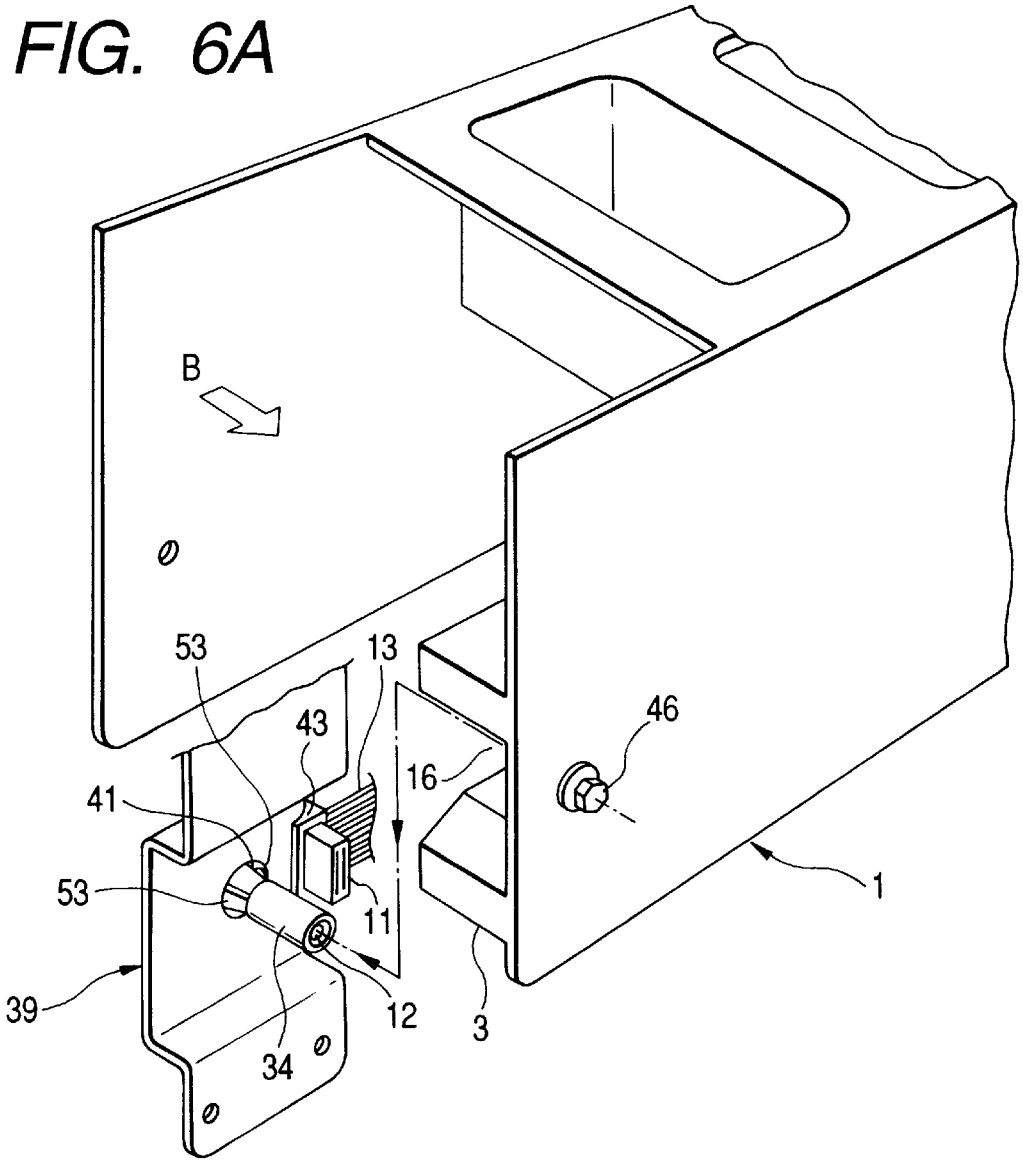
FIG. 6A is a perspective view showing a connector coupling structure provided with a vehicle body panel and a console box casing according to the second embodiment.
Figure 6B:
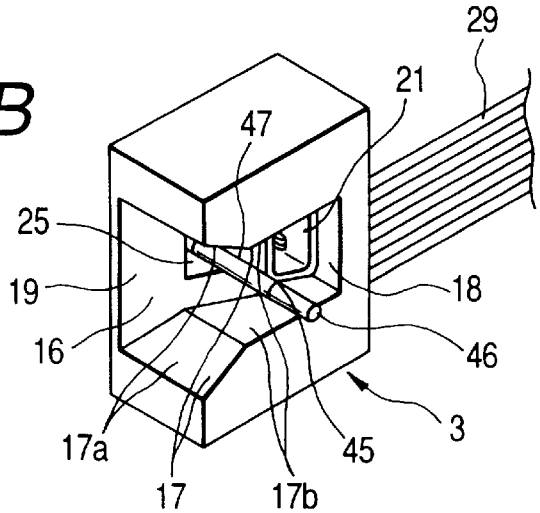
FIG. 6B is a perspective view only showing a connector frame provided with the console box casing, which is viewed from a direction indicated by an arrow B shown in FIG. 6A.
Figure 7A:
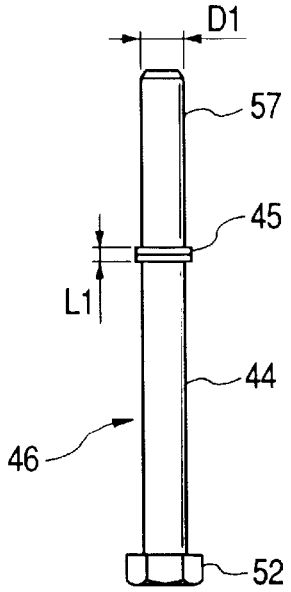
FIG. 7A shows a bolt to be inserted into the connector frame shown in FIG. 5.
Figure 7B:
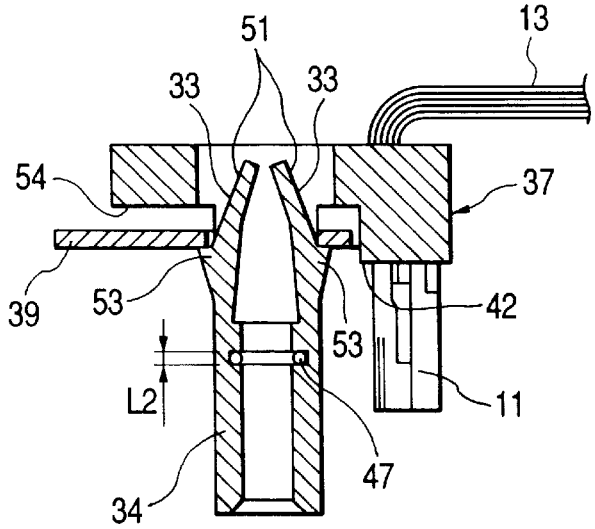
FIG. 7B is a section view showing the connector frame fixed to the vehicle body panel.
Figure 8:
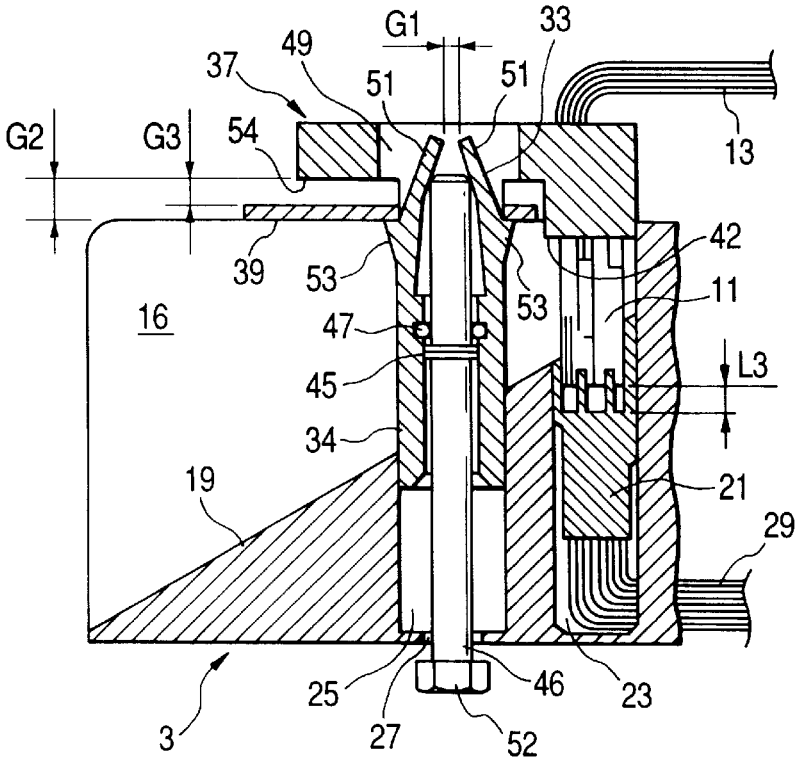
FIG. 8 shows the connector coupling structure of the second embodiment before performing the coupling operation.
Figure 9:
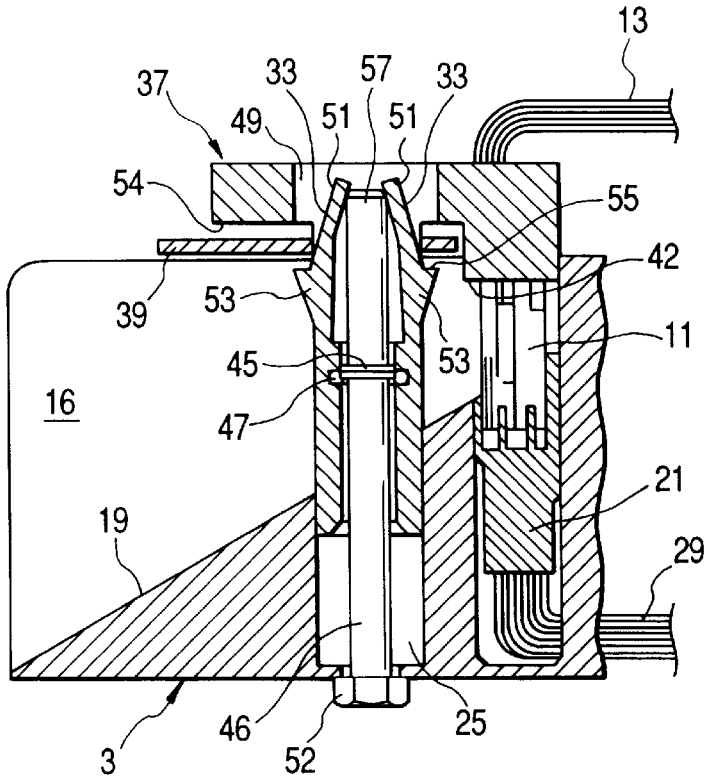
FIG. 9 shows the connector coupling structure of the second embodiment while performing the coupling operation.
Figure 10:
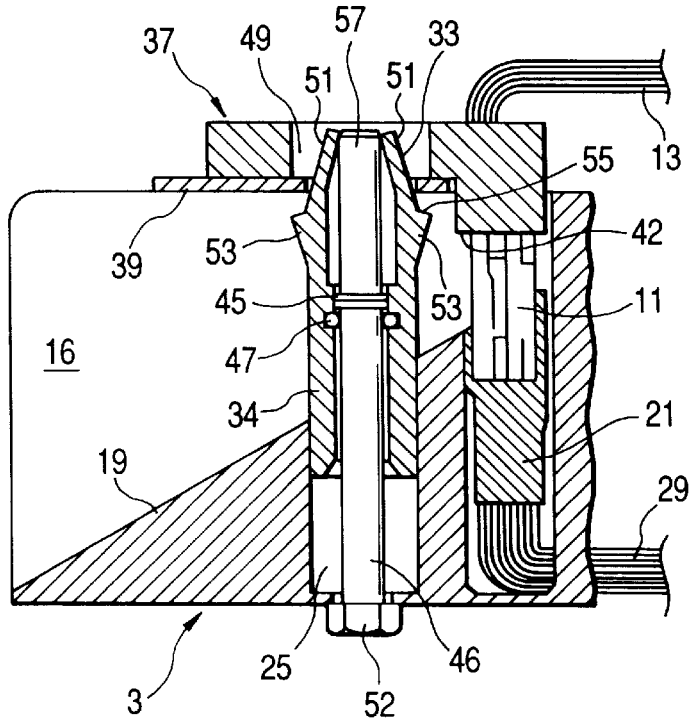
FIG. 10 shows the connector coupling structure of the second embodiment after the coupling operation has been completed.
Figure 11:
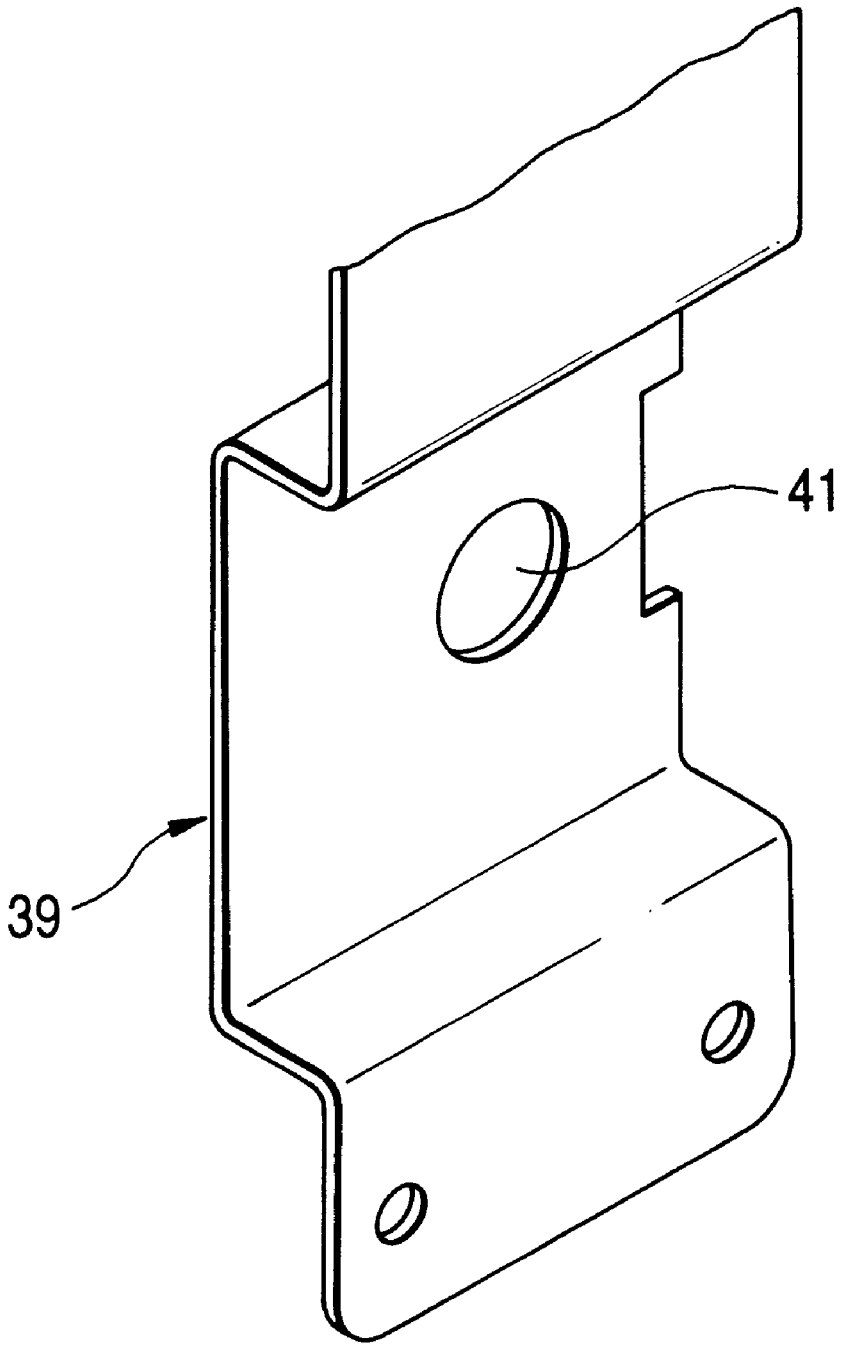
FIG. 11 is a perspective view showing the vehicle body panel of the second embodiment.
Figure 12:
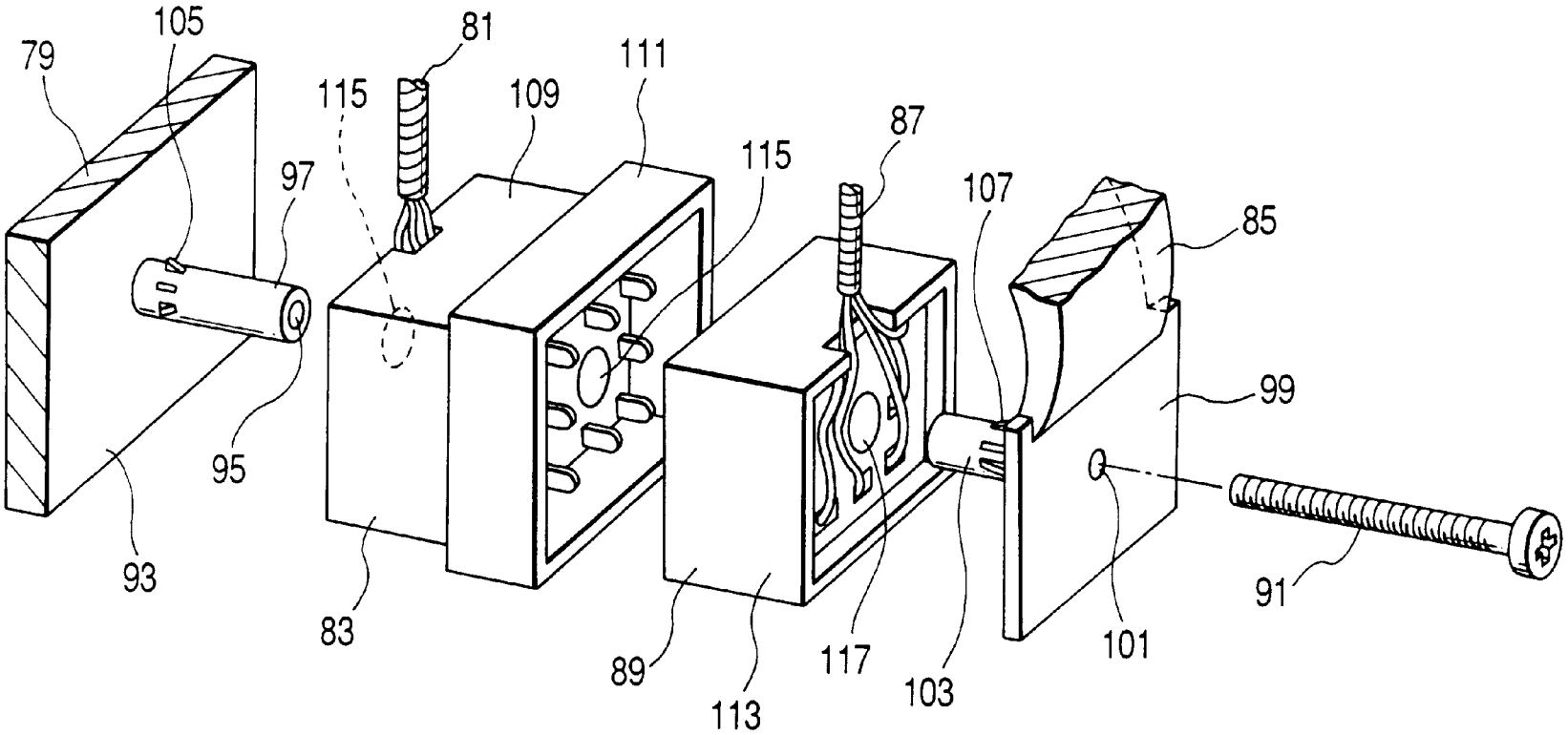
PRIOR ART FIG. 12
FIG. 12 is a perspective view showing a related connector coupling structure.

The second embodiment will be explained with reference to FIGS. 5 to 11. FIG. 5 is a perspective view of a connector frame. FIG. 6A is a perspective view of a vehicle body side panel and a console box casing. FIG. 6B is a perspective view showing only a connector frame portion of the casing side viewed from a direction indicated by an arrow B shown in FIG. 6A. FIG. 7A shows a bolt and FIG. 7B shows the connector frame in which a nut is buried. FIGS. 8 to 10 are diagrams showing the assembling operation of the casing to the vehicle body side panel and the connector coupling operation. FIG. 11 is a perspective view of the vehicle body side panel.

This embodiment differs from the first embodiment in the following points. That is, as shown in FIG. 5, a connector frame 37 having elastic projections 35 and a pillar-shaped projection 34 of a cylinder shape at which tongue shaped pieces 33 are formed is employed in place of the connector frame 7 of the first embodiment, whereby as shown in FIG. 6A, the tongue shaped pieces 33 are provisionally engaged with an engagement hole 41 of a vehicle body side panel 39 thereby to loosely and provisionally engage the connector frame 37 with the vehicle body side panel 39. The frame 37 is provided with a convex portion 42 at the position where the connector 11 is placed, and the sliding faces 43 at the both sides of the convex portion 42 contact with and slide along the parallel portions 17*b* of the connector frame 3. Further, in place of the bolt 8 of the first embodiment, as shown in FIG. 7, a volt 46 having a thread portion 45 provided at a portion of a shaft portion 44 thereof is provided and a nut 47 with a particular thickness is buried in the pillar-shaped projection 34. Since other configuration of this embodiment is same as the first embodiment, such like parts corresponding to those of the first embodiment are marked with the same references and therefor need not be described As shown in FIG. 5, the connector frame 37 is formed in a rectangular flat plate shape and the pair of tongue shaped pieces 33 supported at the center portion of the pillar-shaped projection 34 of a cylinder shape are formed symmetrically and integrally with the projection. The pair of elastic projections 35 are integrally formed at the corresponding positions of the side faces of the long sides of the connector frame 37. As shown in FIGS. 8 to 10, the tongue shaped pieces 33 pass through holes 48 formed at the connector frame 37 and are inserted into a hollow portion 49 formed at the portion corresponding to the pillar-shaped projection 34 of the rear face of the connector frame 37. Each of the tip end portions 51 of the tongue shaped pieces 33 is formed so as to be inclined toward the center axis of the pillar-shaped projection 34 so that a gap G1 between the tip ends of the tongue shaped pieces 33 becomes smaller than the diameter D1 of the shaft portion 44 of the bolt 46 shown in FIG. 7. As shown in FIGS. 8 to 10, each of the tongue shaped pieces 33 is provided at its center portion with an engagement portion 53 expanded outward. A gap G2 between the installation face 54 of the pillar-shaped projection 34 of the connector frame 37 and the end portion 55 of the engagement portion 53 is set to be larger than the thickness of the vehicle body side panel 39. As shown in FIG. 5, each of the elastic projections 35 is inclined toward the installation face side of the pillar-shaped projection 34 from the side face-of the long side of the connector frame 37. As shown in FIG. 11, the vehicle body side panel 39 is provided with a circular engagement hole 41 which size is almost same as that of the tip face of the pillar-shaped projection 34.

As shown in FIG. 7A, the bolt 46 has the thread portion 45 corresponding to the nut 47 at a portion slightly below the center portion of the shaft portion 44, and the shaft diameter of the portion of the shaft portion 44 other than the thread portion 45 is formed to be smaller than the diameter of the minimum hole of the nut 47. The thread portion 45 is formed at such a position that, as shown in FIG. 8, in a state where the connector 11 and the connector 21 are adjusted in their positions to each other and the tip portion of the connector 11 is slightly coupled with the tip portion of the connector 21, when the bolt 46 is inserted into the through hole 12 of the pillar-shaped projection 34 from a hole 27 and the head portion 52 of the bolt 46 contacts with the connector frame 3, the thread portion 45 contacts with the nut 47 to rotate the bolt 46 thereby to fasten the bolt by the nut. Further, the thread portion 45 of the bolt 46 is formed and the nut 47 is buried in such a positional relation that, when the bolt 46 is fastened and the thread portion- 45 disengages from the nut 47, the tip end portion 47 of the bolt 46 is inserted between the tip end portions 51 of the two tongue shaped pieces 33. Further, the thread portion 45 and the nut 47 are formed to have such thickness that the sum of the length L1 of the thread portion 45 and the thickness of the nut 47, that is, the length L2 of the thread portion of the nut 47 shown in FIG. 7 is substantially same as the coupled length L3 of the connector 11 and the connector 21 shown in FIG. 8. In this embodiment, each of the length L1 of the thread portion 45 and the length L2 of the thread portion of the nut 47 is set to be substantially half of the length L3.

According to such a configuration, when the pillar-shaped projection 34 is inserted into the engagement hole 41 of the vehicle body side panel 39 to press the connector frame 37, the engagement portions 53 of the tongue shaped pieces 33 pass the edge portions of the engagement hole 41 and the vehicle body side panel 39 is placed in such a state that it is sandwiched between the end portions 55 of the engagement portions 53 and the installation face 54 of the connector frame 37, as shown in FIG. 8. At this time, the connector frame 37 is biased to the direction away from the vehicle body side panel 39 due to the action of the elastic projection 35. As a result, the connector frame 37 is provisionally engaged with the vehicle body side panel 39 with a clearance G3 as a play therebetween. Like the first embodiment, the connector frame 37 is inserted into the groove portion 16 of the connector frame 3 to set the positions of the connector 11 and the connector 21, and then the bolt 46 is rotated in a state where the bolt 46 is inserted into the hole 27 and the through hole 12 to contact the head portion 52 of the bolt 46 to the connector frame 3, thereby to engage the thread portion 45 with the nut 47. When the bolt 46 is fastened, the connector 11 and the connector 21 approach to each other and are coupled as shown in FIG. 9.

Thereafter, as shown in FIG. 10, when the thread portion 45 of the bolt 46 disengages from the nut 47, the mutual approaching process of the connector 11 and the connector 21 stops and so the mutual coupling of the connectors can be performed without fastening them excessively. In this case, the tip portion of the shaft portion 44 of the bolt 46 is inserted between the tip end portions 51 of the two tongue shaped pieces 33 to expand the distance between the tip end portions 51. Thus, the connector frame 37 is fixed to the vehicle body side panel 39 by means of the tongue shaped pieces 33 and the elastic projection 35, whereby the assembling operation of the casing 1 to the vehicle body side panel 39 can be completed.

In this manner, since the excessive fastening of the bolt can be prevented, the breakage of the connector housing and the terminals within the connector housing due to the application of unnecessary load to the connector and the connector terminals can be prevented. That is, the workability can be improved in the operations such as the assembling of the parts of the vehicle at which the connectors are mounted to the vehicle body.

In this embodiment, although the pillar shaped projection is provided with the pair of tongue shaped pieces 33, the pillar shaped projection may be provided with three or more tongue shaped pieces 33.

As has been described heretofore, according to the invention, the workability can be improved in the operation of assembling the parts at which the connectors are mounted.

Although the present invention has been shown and described with reference to specific preferred embodiments, various changes and. modifications will be apparent to those skilled in the art from the teachings herein. Such changes and modifications as are obvious are deemed to come within the spirit, scope and contemplation of the invention as defined in the appended claims.

What is claimed is:

1. A connector coupling structure comprising:

a first connector frame including:

a fitting groove, a first end portion thereof being opened, opposing side walls thereof having a first width at a second end portion thereof and being wider toward the first end portion, and. bottom face thereof being slanted so as to be deeper at the first end portion;

a first fitting hole formed on the bottom face of the first end portion of the fitting groove, the first fitting hole extending in a direction perpendicular to the fitting groove, the first fitting hole having a bottom;

a first connector provided in the first fitting hole; and a second fitting hole formed on the bottom face of an intermediate portion of the fitting groove, the second fitting hole extending parallel with the first fitting hole; and a second connector frame including:

a base plate having a width substantially identical with the first width of the fitting groove;

a second connector provided on a first face of the base plate; and a fitting projection provided on the first face of the base plate, the longitudinal dimension thereof being longer than a longitudinal dimension of the second connector, the second connector frame inserted into the fitting groove from the opened first end portion thereof, slid along the fitting groove while the tip end of the fitting projection is abutted against the bottom face of the fitting groove to respectively fit the second connector and the fitting projection with the first fitting hole and the second fitting hole in order to couple the second connector with the first connector.

2. The connector coupling structure as set forth in claim 1, wherein the second end portion of the fitting groove is closed wall face so that the second connector and the fitting projection respectively faces to the first fitting hole and the second fitting hole when the side face of the base plate is abutted against the closed wall face.

3. The connector coupling structure as set forth in claim 1, wherein the first connector frame includes a bolt inserted from an opening formed on the bottom of the second fitting hole;

wherein the second connector frame includes a through hole piercing the fitting projection into which the bolt is inserted, and a nut buried in the fitting projection coaxially with the through hole, with which the bolt is fitted; and wherein the tightening operation of the bolt and the nut moves the second connector toward the first connector.

4. The connector coupling structure as set forth in claim 3, wherein the bolt includes a thread portion positioned so as to disengage from the nut when the first connector and the second connector are completely coupled after the tightening operation.

5. The connector coupling structure as set forth in claim 3, wherein a thread portion is formed such that the coupling length of the first connector and the second connector is substantially the same as an additional length of a length of the thread portion and a thickness of the nut.

6. The connector coupling structure as set forth in claim 3, wherein the fitting projection. includes an engagement member formed on an circumferential face thereof;

wherein the fitting projection is inserted into an opening formed on a plate member, to which the second connector frame is fixed, such that the plate member is provisionally engaged between the engagement member and the first face of the base plate;

wherein an interval between the engagement member and the first face of the base plate is wider than the thickness of the plate member; and wherein the fitting projection includes elastic pieces extending from a base end portion thereof through the base plate, an interval of which is narrower than the diameter of the bolt so that the elastic pieces are spread out by the insertion of the bolt, thereby the plate member is movable between the engagement member and the first face of the base plate according to the insertion degree of the bolt.

7. The connector coupling structure as set forth in claim 1, wherein a corner portion of the tip end of the fitting projection is tapered.

* * * * *